US009576477B2

(12) United States Patent
Zhang et al.

(10) Patent No.: US 9,576,477 B2
(45) Date of Patent: Feb. 21, 2017

(54) ELECTRICAL EQUIPMENT AND REMOTE CONTROL RECEIVING REMOTE SIGNAL BY ELECTRO-MAGNETIC INDUCTION

(71) Applicants: AMBIT MICROSYSTEMS (SHANGHAI) LTD., Shanghai (CN); HON HAI PRECISION INDUSTRY CO., LTD., New Taipei (TW)

(72) Inventors: Zhi-Ming Zhang, Shanghai (CN); Bin Jiang, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/854,578

(22) Filed: Sep. 15, 2015

(65) Prior Publication Data

US 2016/0104372 A1 Apr. 14, 2016

(30) Foreign Application Priority Data

Oct. 14, 2014 (CN) ..... 2014 1 0539592

(51) Int. Cl.
*G08C 17/02* (2006.01)

(52) U.S. Cl.
CPC ..... *G08C 17/02* (2013.01)

(58) Field of Classification Search
CPC ..... G08C 17/02; Y10T 307/773
See application file for complete search history.

(56) References Cited

U.S. PATENT DOCUMENTS

2005/0093374 A1* 5/2005 Connors ..... G06K 19/0705 307/126
2008/0136594 A1* 6/2008 Jung ..... G06K 19/0701 340/10.1
2013/0119783 A1* 5/2013 Xu ..... H02J 5/00 307/125

FOREIGN PATENT DOCUMENTS

| | | | |
|---|---|---|---|
| CN | 101605387 | A | 12/2009 |
| CN | 201429898 | Y | 3/2010 |
| CN | 101841678 | A | 9/2010 |
| CN | 102025183 | A | 4/2011 |
| CN | 103078414 | A | 5/2013 |
| CN | 204516009 | U | 7/2015 |

* cited by examiner

*Primary Examiner* — Nabil Syed
(74) *Attorney, Agent, or Firm* — Zhigang Ma

(57) ABSTRACT

Electrical equipment includes a power supply unit, a signal receiving unit, a rectifying and filtering unit, a switch unit, and a control. The rectifying and filtering unit rectifies and filters remote signals received by the signal receiving unit to generate first voltage signals. The switch unit connects the power supply unit to an external power in response to receiving the first voltage signals. The control identifies a current mode of the electrical equipment and determines whether the first voltage signal persists longer than a predetermined time or not. The control outputs a second voltage signals in response to the duration time of the first voltage signals being greater than the predetermined time. The switch unit further connects the power supply unit to the external power according to the first voltage signal and the second voltage signal to start the electrical equipment.

7 Claims, 3 Drawing Sheets

ELECTRICAL EQUIPMENT AND REMOTE CONTROL RECEIVING REMOTE SIGNAL BY ELECTRO-MAGNETIC INDUCTION

CROSS-REFERENCE TO RELATED APPLICATIONS

This application claims priority to Chinese Patent Application No. 201410539592.4 filed on Oct. 14, 2014, the contents of which are incorporated by reference herein.

FIELD

The subject matter herein generally relates to electrical equipment, and particularly to remote control and electrical equipment receiving a remote signal via electromagnetic induction.

BACKGROUND

Most electrical equipment is configured with a remote control for controlling a start up mode and a standby mode. Although the electrical equipment is in the standby mode, the electrical equipment still consumes power.

BRIEF DESCRIPTION OF THE DRAWINGS

Implementations of the present technology will now be described, by way of example only, with reference to the attached figures.

DETAILED DESCRIPTION

Figure 1:
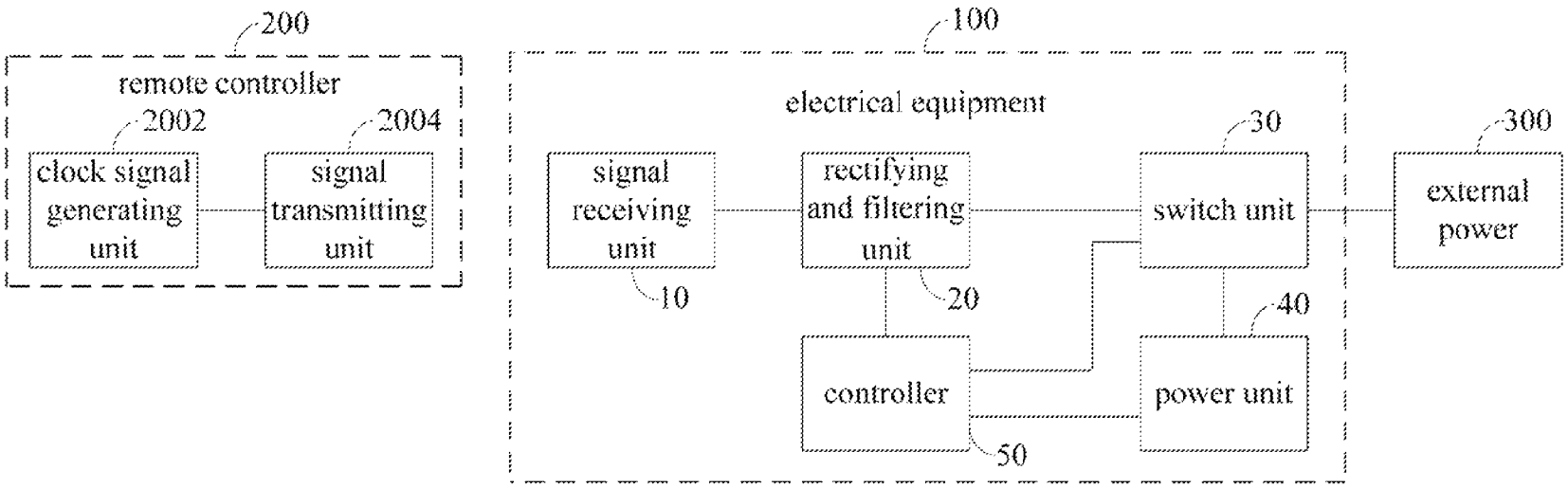
FIG. 1 is a diagram of a first embodiment of a remote control and electrical equipment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The term "comprising," when utilized, means "including, but not necessarily limited to"; it specifically indicates open-ended inclusion or membership in the so-described combination, group, series and the like.

FIG. 1 illustrates a first embodiment of electrical equipment 100 and a remote control 200. In at least one embodiment, the electrical equipment 100 comprises a start up mode and a shut down mode. The remote control 200 is configured to turn on or turn off the electrical equipment 100. In at least one embodiment, the electrical equipment 100 also may be set in the start up mode or the shut down mode by a button (not shown) located in the electrical equipment 100.

In at least one embodiment, when the electrical equipment 100 is connected to an external power source 300, the remote control 200 controls the electrical equipment 100 to receive an electrical signal output by the external power source 300 through a transmission of a remote signal. When the electrical equipment receives the electrical signal from the external power source 300, the electrical equipment 100 is in the start up mode, thus the electrical equipment 100 works normally. When the electrical equipment does not receive the electrical signal from the external power 300, the electrical equipment 100 is in the shut down mode, thus the electrical equipment 100 stops working.

The remote control 200 comprises a clock signal generating unit 2002 and a signal transmitting unit 2004 connected to the clock signal generating unit 2002. The clock signal generating unit 2002 generates a clock signal with a predetermined frequency. The signal transmitting unit 2004 generates and transmits the remote signal according to the clock signal output by the clock signal generating unit 2002. In at least one embodiment, the clock signal generating unit 2002 outputs a square wave signal, and the remote signal is an electromagnetic wave signal.

The electrical equipment 100 comprises a signal receiving unit 10, a rectifying and filtering unit 20, a switch unit 30, a power supply unit 40 and a control 50. In at least one embodiment, the electrical equipment 100 works normally when the power supply unit 40 receives the electrical signal output by the external power source 300. Once the power supply unit 40 does not receive the electrical signal output by the external power source 300, the electrical equipment 100 stops working because the electrical equipment 100 is powered off. The signal receiving unit 10 connected to the rectifying and filtering unit 20 is configured to receive the remote signal output by the remote control 200. The rectifying and filtering unit 20 rectifies and filters the remote signal received by the signal receiving unit 10 to generate a first voltage signal. The switch unit 30 is connected to the rectifying and filtering unit 20, the power supply unit 40 and the external power source 300. The switch unit 30 connects the power supply unit 40 to the external power source 300 in response to receiving the first voltage signal output by the rectifying and filtering unit 20, thus the power supply unit 40 receives the electrical signal from the external power source 300. The control 50 is connected to the rectifying and filtering unit 20 and the power supply unit 40. The control 50 identifies the current mode of the electrical equipment 100 and determines whether the first voltage signal output by the rectifying and filtering unit 20 persists longer than a predetermined time or not. When the control 50 determines the first voltage signals persists longer than a predetermined time, and the electrical equipment 100 is in the shut down mode, the control 50 outputs a second voltage signal. The switch unit 30 further connects the power supply unit 40 to the external power source 300 according to the first voltage signal output by the rectifying and filtering unit 20 and the second voltage signal output by the control 50 to start the electrical equipment 100.

The control 50 is powered by the power supply unit 40. Since the remote signal received by the signal receiving unit 10 is not a durative signal, when the remote control 200 does not transmit the remote signal, the rectifying and filtering unit 20 does not output the first voltage signal, thus the first voltage signal disappears.

When the switch unit receives the first voltage signal output by the rectifying and filtering unit 20, the switch unit 30 is switched to close to receive the electrical signal of power supply unit 40, thus the control 50 may monitor a duration time of the remote signal. When the remote signal persists longer than a predetermined time, the control 50 outputs the second voltage signal. Though the remote signal disappears, the switch unit 30 further receives the second voltage signal output by the control 50, thus the switch unit 30 is switched on to start the electrical equipment 100. When the electrical equipment 100 works normally, if the control 50 detects the remote signal again and if the remote signal persists longer than the predetermined time, the control 50 outputs a third voltage signal. The switch unit 30 is further configured to disconnect the power supply unit 40 to the external power source 300 when the switch unit 30 receives the third voltage signal output by the control 50, in order to shut off the electrical equipment 100.

In at least one embodiment, the signal transmitting unit 2004 transmits the remote signal and the signal receiving unit 10 receives the remote signal according to the electromagnetic resonance. Thus the frequency of the clock signal generated by the clock signal generating unit 2004 is set according to the resonance occurred between the signal transmitting unit 10 and the signal receiving unit 2002.

Predetermined time can be set according to actual situation to avoid an error in the control by the remote control 50. In at least one embodiment, predetermined time can be set to 3 seconds. Each time the control 50 detects the remote control signal, the control 50 resets timing. Thus the control 50 determines the existence of the remote control signal and the duration of the remote control signal is counted and calculated from the zero.

In at least one embodiment, according to electromagnetic inductive resonance, the remote signal can be transmitted and can be received, and the electrical equipment 100 cross controls the connection of the power supply unit 40 and the external power 300 through the remote control signal and the voltage signals output by control 50. Thus the electrical equipment 100 may be directly turned on and turned off through the remote control 200. The electrical equipment 100 is shut off without standby power consumption; thereby the power consumption of the electrical equipment 100 is zero. Furthermore the electrical equipment 100 can still be started by the remote control 200 although the electrical equipment 100 is shut off absolutely.

Figure 2:
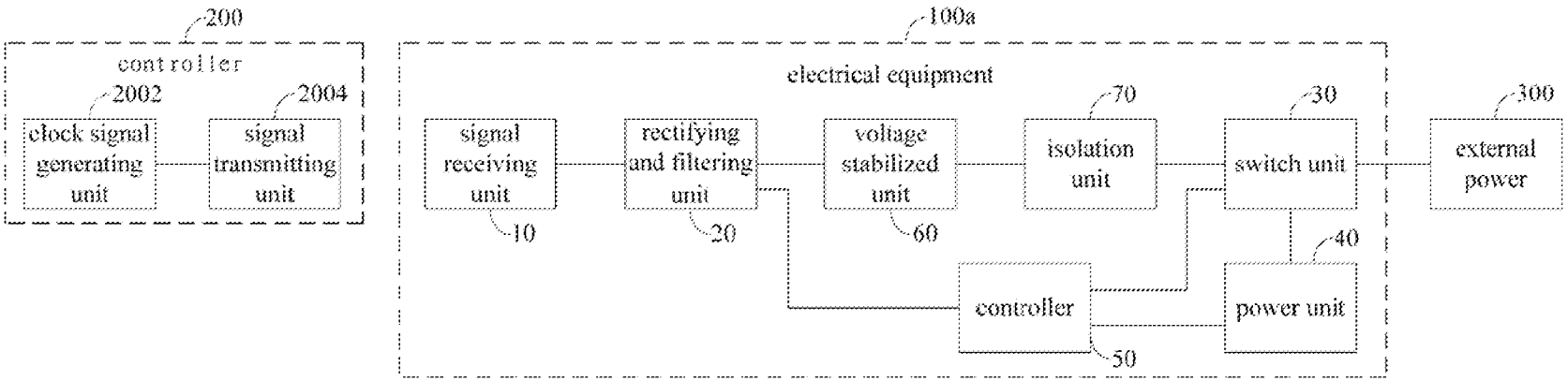
FIG. 2 is a diagram of a second embodiment of the remote control and the electrical equipment.

FIG. 2 illustrates a second embodiment of the electrical equipment 100*a*. In at least one embodiment, the electrical equipment 100*a* is similar to the electrical equipment 100 as shown in FIG. 1. The difference is that the electrical equipment 100*a* further comprises a voltage stabilizer unit 60 and an isolation unit 70. The voltage stabilizer unit 60 and the isolation unit 70 are connected between the rectifying and filtering unit 20 and the switch unit 30 in turn. The voltage stabilizer unit 60 stabilizes the first voltage signal output by the rectifying and filtering unit 20 to generate a desired direct-current voltage signal to drive the switch unit 30. The isolation unit 70 separates the rectifying and filtering unit 20 from the control 50, thus the control 50 sends the second voltage signal or the third voltage signal to the switch unit 30.

Figure 3:
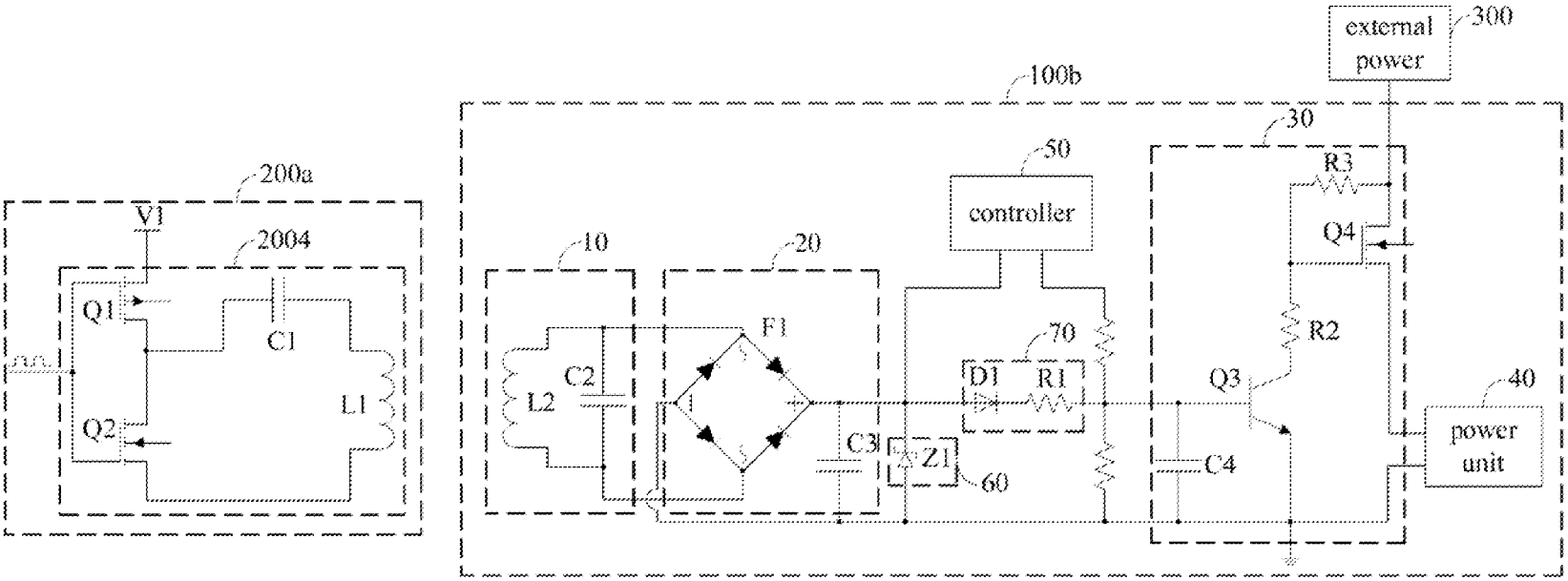
FIG. 3 is a circuit diagram of a first embodiment of the remote control and the electrical equipment.

FIG. 3 illustrates a first embodiment of electrical equipment 100*b* and the remote control 200*a*. In at least one embodiment, the clock generating unit 2002 outputs a square wave signal. The clock generating unit 2002 may be a module or a device capable of outputting a square wave, such as a square wave generated circuit.

The signal transmitting unit 2004 comprises a first inductor L1, a first capacitor C1, a first switch Q1 and a second switch Q2. The first switch Q1 comprises a first end, a second end and a control end. The first end of the first switch Q1 is connected to one end of the first capacitor, and the control end of the first switch Q1 is connected to the clock generating unit 2002. The second end of the first switch Q1 is configured to receive the electrical signal output by the first power V1.

The second switch Q2 comprises a first end, a second end and a control end. The first end of the first switch Q2 is connected to one end of the first capacitor and the common end of the first switch Q1, and the second end of the first switch Q2 is connected to one end of the first inductor L1, and the control end of the first switch Q2 is connected to the clock generating unit 2002. The other end of the first inductor L1 is connected to the other end of the first capacitor C1.

In at least one embodiment, the first power V1 can be a battery (not shown) set inside the remote control 200*a*. The remote control 200*a* may control the clock generating unit 2002 to output or not output the clock signal by the button (not shown) set on the remote control 200*a*, thus the remote control 200*a* may transmit the remote control signal by the button.

The signal receiving unit 10 comprises a second inductor L2 and a second capacitor C2. In at least one embodiment, the second capacitor C2 and the second inductor L2 are in parallel connection in the inner of the signal receiving unit 10, and the first inductor L1 and the first capacitor C1 are in series connection in the inner of the remote control 200*a*. Resonance occurs among the first inductor L1, the first capacitor C1, the second inductor L2 and the second capacitor C2 to implement the transmission of the remote control signal via the remote control 200*a*. The signal receiving unit 10 may receive the remote control signal.

The rectifying and filtering unit 20 comprises a full bridge rectifier circuit F1 and a third capacitor C3. The full bridge rectifier circuit F1 comprises a first input end, a second input end, a first output end, and a second output end. The first input end of the full bridge rectifier circuit F1 is connected to one end of the second capacitor C2. The second input end of the full bridge rectifier circuit F1 is connected to the other end of the second capacitor C2. The first output end of the full bridge rectifier circuit F1 is connected to one end of the third capacitor C3. The second output end of the full bridge rectifier circuit F1 is connected to the ground, and the other end of the third capacitor C3 is connected to the ground.

The rectifying and filtering unit 20 rectifies the remote control signal received by the signal receiving unit 10 through the full bridge rectifier circuit F1, and filters the remote control signal through the third capacitor C3 to output the first voltage signal in the form of direct-current voltage. The voltage stabilizer unit 60 comprises a stabilivolt Z1. An anode of the stabilivolt Z1 is connected to the ground, and a cathode of the stabilivolt Z1 is connected to one end of the third capacitor C3 and the isolation unit 70. The stabilivolt Z1 is configured to stabilize the first voltage signal output by the third capacitor C3 to output the desired first voltage signal. In at least one embodiment, the value of the stabilivolt Z1 is 3V.

The isolation unit 70 comprises a diode D1 and a first resistor R1. An anode of the diode is connected to the cathode of the stabilivolt Z1, and a cathode of the diode D1 is connected to one end of the first resistor, and the other end of first resistor R1 is connected to the switch unit 30. The switch unit 30 comprises a fourth capacitor C4, a third switch Q3, a fourth switch Q4, a second resistor R2, and a third resistor R3. The third switch Q3 comprises a first end, a second end, and a control end. The first end of the third switch Q3 is connected to one end of the second resistor, and the second end of the third switch Q3 is connected to the ground. The control end of the third switch Q3 is connected to one end of the fourth capacitor C4 and the other end of the first resistor R1, and the other end of the fourth capacitor C4 is connected to the ground.

The fourth switch Q4 comprises a first end, a second end, and a control end. The first end of the fourth switch Q4 is connected to the external power source 300, and the second end of the fourth switch Q4 is connected to a power supply unit 40, and the control end of the fourth switch Q4 is connected to the other end of the second resistor R2. One end of the third resistor R3 is connected to the common end between the second resistor R2 and the fourth switch Q4, and the other end of the third resistor R3 is connected to the first end of the fourth switch Q4.

The switch unit 30 closes or opens the third switch Q3 and the fourth switch Q4 by receiving the voltage signals, to connect or disconnect the external power source 300 to the power supply unit 40. The control 50 comprises a first pin P1 and a second pin P2. The first pin P1 is connected to the anode of the diode D1, and the second pin P2 is connected to the control end of the third switch Q3.

The control 50 determines whether the signal receiving unit 10 receives the remote control signal or not according to the first pin P1. The control 50 further determines the duration time of the remote control signal. When the control 50 determines that the remote control signal persists longer than the predetermined time, the control 50 outputs the second voltage signal or the third voltage signal by the second pin P2. In at least one embodiment, the second voltage signal is a high level signal, and the third voltage signal is a low level signal. The first switch Q1 and the fourth switch Q4 can be a P-channel field effect transistor, and the second switch Q2 can be an N-channel field effect transistor, and the third switch Q3 can be an NPN transistor. In at least one embodiment, the first switch Q1 and the second switch Q2 can be replaced with a bidirectional field effect transistor.

As described above, the control 50 and the electrical equipment 100 transmit and receive the remote control signal by electromagnetic resonance, thus the electrical equipment 100 may be shut off absolutely to avoid unnecessary standby power consumption.

Many details are often found in the art such as the other features of electrical equipment and remote control. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An electrical equipment comprising:

a power supply unit;

a signal receiving unit to receive a remote control signal;

a rectifying and filtering unit connected to the signal receiving unit to rectify and filter the remote control signal to generate a first voltage signal;

a switch unit connected to the rectifying and filtering unit, the power supply unit, and an external power source, wherein the switch unit connects the power supply unit to the external power source when the switch unit receives the first voltage signal;

a control connected to the power supply unit and the rectifying and filtering unit, to identify a current mode of the electrical equipment and to determine whether the first voltage signal persists longer than a predetermined time, wherein the current mode of the electrical equipment comprises a start up mode and a shut down mode; and an isolation unit configured to separate the control from the rectifying and filtering unit, thus the control outputs the second voltage signal to the switch unit wherein the isolation unit comprises a first diode with an anode end connected to the rectifying and filtering unit; and a first resistor with one end connected to a cathode of the first diode and with the other end connected to the switch unit and the control;

wherein the control further outputs a second voltage signal to the switch unit when the first voltage signals persists longer than the predetermined time and the electrical equipment is in the shut down mode, wherein the switch unit connects the power supply unit to the external power source according to the first voltage signal and the second voltage signal, to start the electrical equipment.

2. The electrical equipment of claim 1, wherein the control further outputs a third voltage signal to the switch when the first voltage signal persists longer than the predetermined time and the electrical equipment is in the start up mode, when the switch unit receives the third voltage signal, the switch unit disconnects the power supply unit to the external power, to shut off the electrical equipment.

3. The electrical equipment of claim 2, wherein the control does not output the second voltage signal or the third voltage signal when the first voltage signal persists less than the predetermined time.

4. The electrical equipment of claim 1, wherein the switch unit connects the power supply unit to the external power source to start the electrical equipment according to the second voltage signal when the first voltage signal disappears.

5. The electrical equipment of claim 1, wherein the switch unit comprises:

a first switch comprising a first switch first end, a first switch second end connected to the ground, and a first switch control end connected to the rectifying and filtering unit and the control;

a first capacitor with a first capacitor first end connected to the control end of the first switch and a first capacitor second end connected to the ground;

a second resistor with a second resistor first end connected to the first switch first end, and a second resistor second end;

a third resistor with a third resistor first end connected to the second resistor second end, and a third resistor second end connected to the external power source; and a second switch with a second switch first end connected to the external power source, a second switch second end connected to the power supply unit, and a second switch control end connected to a common end of the second resistor and the third resistor.

6. The electrical equipment of claim 1, wherein the remote control signal is a electromagnetic wave, and the signal receiving unit comprises a first inductor and a second capacitor paralleled with the first inductor.

7. An electrical equipment comprising:

a power supply unit;

a signal receiving unit to receive a remote control signal;

a rectifying and filtering unit connected to the signal receiving unit to rectify and filter the remote control signal to generate a first voltage signal;

a switch unit connected to the rectifying and filtering unit, the power supply unit, and the an external power source, wherein the switch unit connects the power supply unit to the external power source when the switch unit receives the first voltage signal; and a control connected to the power supply unit and the rectifying and filtering unit, to identify the a current mode of the electrical equipment and to determine whether the first voltage signal persists longer than a predetermined time, wherein the current mode of the electrical equipment comprises a start up mode and a shut down mode;

wherein the control further outputs a second voltage signal to the switch unit when the first voltage signals persists longer than the predetermined time and the electrical equipment is in the shut down mode, wherein the switch unit connects the power supply unit to the external power source according to the first voltage signal and the second voltage signal, to start the electrical equipment;

wherein the switch unit comprises:

a first switch comprising a first switch first end, a first switch second end connected to ground, and a first switch control end connected to the rectifying and filtering unit and the control;

a first capacitor with a first capacitor first end connected to the control end of the first switch, and a first capacitor second end connected to the ground;

a second resistor with a second resistor first end connected to the first end of the first switch;

a third resistor with a third resistor first end connected to the second resistor second end, and a third resistor second end connected to the external power source; and a second switch with a second switch first end connected to the external power source, a second switch second end connected to the power supply unit, and a second switch control end connected to a common end of the second resistor and the third resistor.

* * * * *